United States Patent [19]

Sasaki et al.

[11] Patent Number: 4,815,532

[45] Date of Patent: Mar. 28, 1989

[54] STACK TYPE HEAT EXCHANGER

[75] Inventors: Hironaka Sasaki, Shimodateshi; Ryoichi Hoshino, Oyamashi, both of Japan

[73] Assignee: Showa Aluminum Kabushiki Kaisha, Osaka, Japan

[21] Appl. No.: 18,155

[22] Filed: Feb. 24, 1987

[30] Foreign Application Priority Data

| | | | |
|---|---|---|---|
| Feb. 28, 1986 | [JP] | Japan | 61-44621 |
| Jul. 24, 1986 | [JP] | Japan | 61-175389 |
| Sep. 12, 1986 | [JP] | Japan | 61-140835[U] |
| Sep. 16, 1986 | [JP] | Japan | 61-142471[U] |

[51] Int. Cl.[4] ..... F28D 1/02

[52] U.S. Cl. ..... 165/152; 165/153

[58] Field of Search ..... 165/152, 153, 166

[56] References Cited

U.S. PATENT DOCUMENTS

| | | | |
|---|---|---|---|
| 2,360,123 | 10/1944 | Gerstung et al. | 165/153 X |
| 3,635,283 | 1/1972 | Satchwell | 165/152 X |
| 4,327,802 | 5/1982 | Beldam | 165/153 |
| 4,712,612 | 12/1987 | Okamoto et al. | 165/110 X |

FOREIGN PATENT DOCUMENTS

| | | | |
|---|---|---|---|
| 3215961 | 11/1983 | Fed. Rep. of Germany | 165/153 |

*Primary Examiner*—Ira S. Lazarus
*Assistant Examiner*—Peggy Neils

[57] ABSTRACT

A stack type heat exchanger which comprises a plurality of tubular elements including a tank section at least at one end, the tubular elements being adapted to allow a heat exchange medium to pass through; a plurality of air paths interposed between one tubular element and the next, each of the air paths being provided with a fin member; wherein each tubular element comprises a pair of metal tray members jointed at their peripheries with an inner plate interposed therebetween; wherein each inner plate is provided with projections on its top surfaces and undersurface so that the flows of the medium are blocked by the projections so as to enlarge the effective area for heat transfer between the medium and the tubular element.

8 Claims, 9 Drawing Sheets

STACK TYPE HEAT EXCHANGER

BACKGROUND OF THE INVENTION

1. Field of the Invention

The present invention relates to a stack type heat exchanger, and more particularly to a stack type heat exchanger for use as a vaporizer in the car cooling system and oil cooler, wherein the heat exchanger comprises a plurality of tubular elements including an inner fin member are stacked horizontally or vertically with the interposition of air paths between one tubular element and the next, each of the air paths including an outer fin member.

2. Description of the Prior Art

There is generally known all-purpose stack type heat exchangers which comprise a plurality of tubular elements stacked with the interposition of outer fins between one tubular element and the next, wherein each tubular element comprises a pair of metal plates of thermal conductivity having a tank at least at one end for storing a heat exchange medium. The known heat exchanger of this type are advantageous in that they withstand varying loads applied thereto, and exhibit good performance for its limited capacity.

In order to enhance the efficiency of heat exchange the metal plates are provided with numerous projections and recesses so as to enlarge the effective area for heat transfer (e.g. Japanese Utility Model Laid-Open Specification No. 59-116787). There is another proposal for using a corrugated plate as an inner fin member, which is shown by the reference numeral 100 in FIG. 24.

However it has been found that the uneven surfaces of the metal plates in the first-mentioned proposal is not as effective to increase the area for heat transfer as it is expected, thereby resulting in the limited increase in the efficiency of heat exchange. In the second-mentioned proposal the corrugated plates provide straightforward medium paths, which causes the medium to flow straight. The straightforward flow, though it means a smooth or trouble-free flow, is nevertheless not very effective to increase the effective area for heat exchange.

It is generally appreciated that the inner fins reinforce the tubular elements against a possible compression. However the tubular elements are liable to an elongating stress, particularly when the medium is gasifiable. Under this elongating stress the tubular element tend to become deformed or broken in their joints.

OBJECTS AND SUMMARY OF THE INVENTION

The present invention aims at solving the problems pointed out above with respect to the known stack type heat exchangers, and has for its object to provide an improved stack type heat exchanger capable of exchanging heat efficiently.

Another object of the present invention is to provide an improved stack type heat exchanger capable of withstanding internal and external stresses inflicted by the passing heat exchange medium.

Other objects and advantages of the present invention will become more apparent from the following detailed description, when taken in conjunction with the accompanying drawings which show, for the purpose of illustration only, one embodiment in accordance with the present invention.

According to the present invention there is provided a stack type heat exchanger which comprises:

- a plurality of tubular elements including a tank section at least at one end, the tubular elements being adapted to allow a heat exchange medium to pass through;
- a plurality of air paths interposed between one tubular element and the next, each of the air paths being provided with a fin member;
- wherein each tubular element comprises a pair of metal tray members jointed at their peripheries with an inner plate interposed therebetween;
- wherein each inner plate is provided with projections on its top surfaces and undersurface so that the flows of the medium are blocked by the projections so as to enlarge the effective area of contact between the medium and the tubular elements.

DETAILED DESCRIPTION OF THE PREFERRED EMBODIMENT

Figure 2:
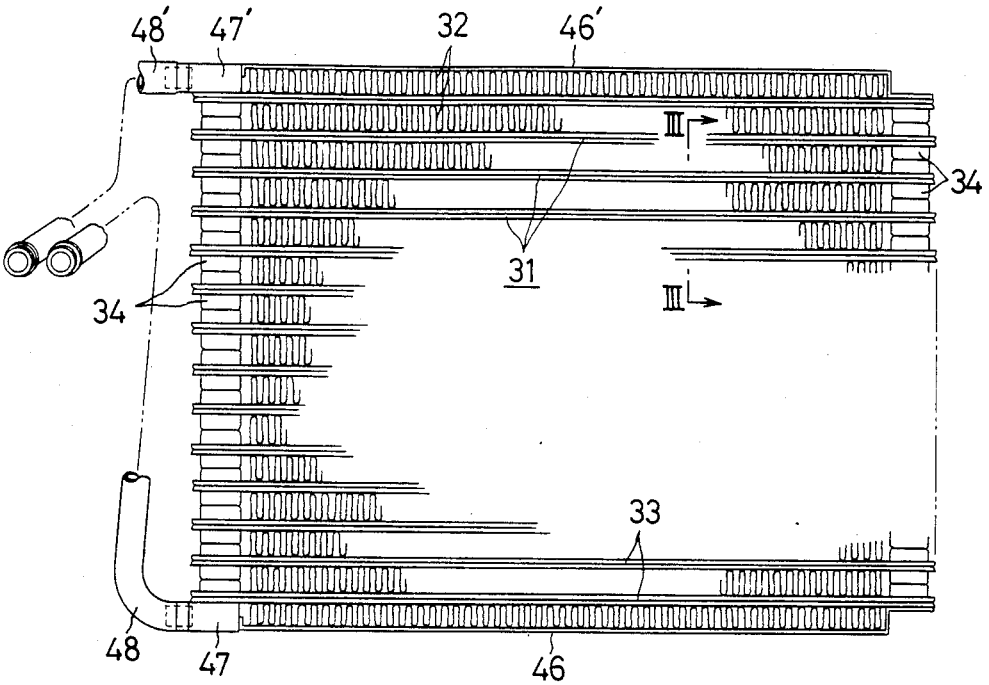
FIG. 2 is a front view showing a horizontal stack type heat exchanger according to the present invention.

Referring to FIG. 2 there are provided planar tubular elements 31 horizontally arranged in a stack, with the interposition of outer fins 32 between one tubular element and the next.

Figure 3:
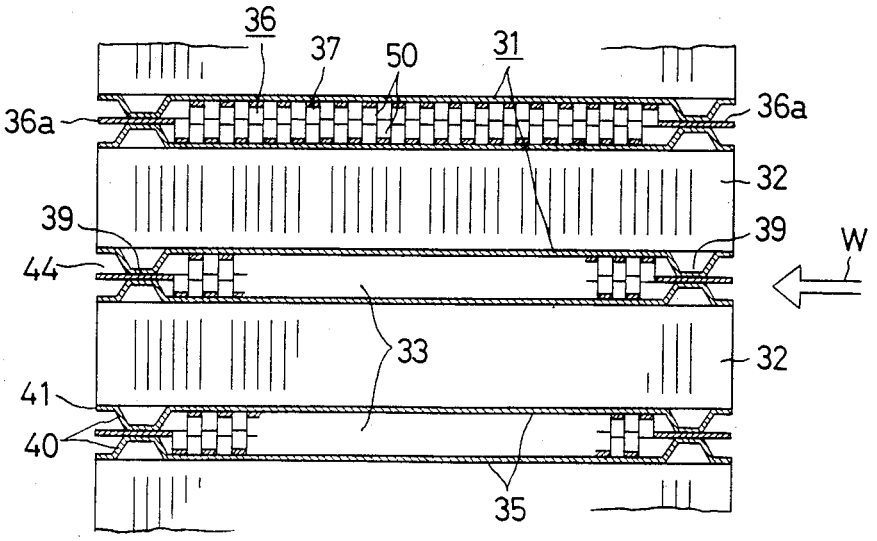
FIG. 3 is a cross-sectional view taken along the line III—III in FIG. 2.

As best shown in FIG. 3 the tubular element 31 includes a passage 33 for passing a heat exchange medium through. Each tubular element 31 includes tanks 34 located at its opposite ends, the tanks 34 communicating with the medium passage 33, and being soldered one after another.

Figure 1:
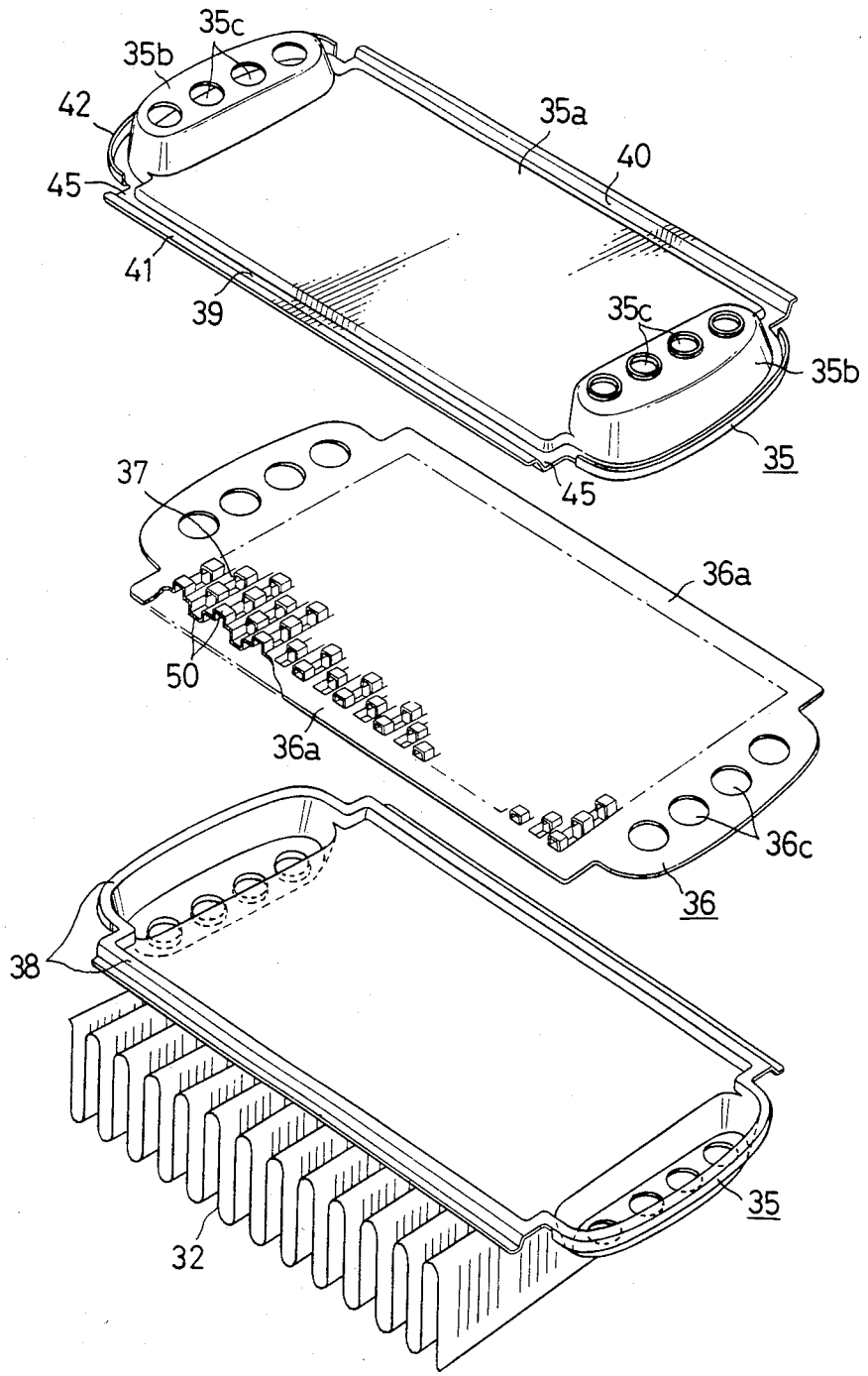
FIG. 1 is a prespective view showing a heat exchanger, disassembled for illustration purpose, according to the present invention.

As shown in FIG. 1 the tubular element 31 is made up of two tray members 35, which are jointed with an inner plate 36 being interlocated. For explanation convenience one of the tray members 35 is referred to as a lower tray member and the other is as an upper tray member. Each tray member 35 has a concave bottom, and the two members 35 are jointed with their concave bottoms being faced to each other as best shown in FIG. 5, so as to produce a fairly widened space 35*a* therebetween.

Figure 4:
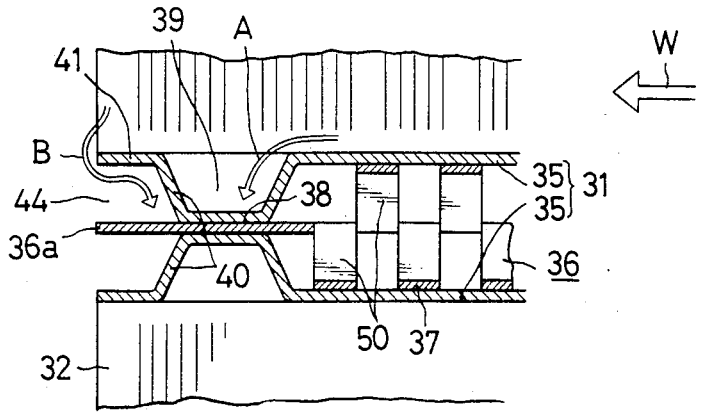
FIG. 4 is a cross-sectional view on an enlarged scale showing a part of the heat exchanger of FIG. 3.

The tray member 35 includes raise sections 35*b* at opposite ends, the raised section having apertures 35*c* which communicate with the apertures 36*c* of the inner plate 36. These apertures 35*c*. and 36*c* are intended as medium passageways. The tray member 35 has rims 38 along the periphery thereof, the rims 38 being bent to constitute dew collecting troughs 39 as shown in FIGS. 3 and 5. The rim 38 includes side walls 40 and a flat eave 41 as shown in FIG. 4. The reference numeral 42 denotes a guard wall. The tray member 35 is made of aluminum by press.

Figure 6:
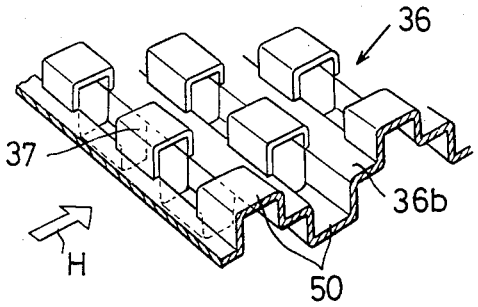
FIG. 6 is a perspectively view showing an example of inner fins provided in each tubular exchanger.
Figure 7:
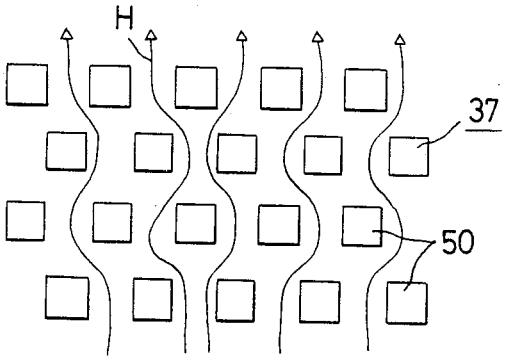
FIG. 7 is a diagrammatic plan view showing the inner fins particularly to show the flows of the heat exchange medium.

The inner plate 36, made of aluminum, has edges 36*a* at opposite sides, the edges being extended into spaces 44 defined by the side walls 40 as best shown in FIG. 4. The inner plate 36 is provided with fins 37 so as to fill the medium passage 33 when the tray members 35 are jointed to each other. The fins 37 is made up of rectangular projections 50, which are arranged at equal intervals in straight lines perpendicular to the flowing direction (H) of the medium, and which are arranged in zigzag manners in the flowing direction (H) of the medium as shown in FIG. 6 and 7. Because of the zigzag arrangements of the projections 50 the flow of the medium is blocked by one projection after another. Each projection has open ends in a direction perpendicular to the flowing direction (H) of the medium, and has a height equal to that of the adjacent one. The height of the projections 50 are determined so that they are fit in the space defined by the two tray members 35 as shown in FIGS. 4 and 5. The fins 37 are used to reinforce the passage 33 and increase the efficiency of heat exchange.

Figure 5:
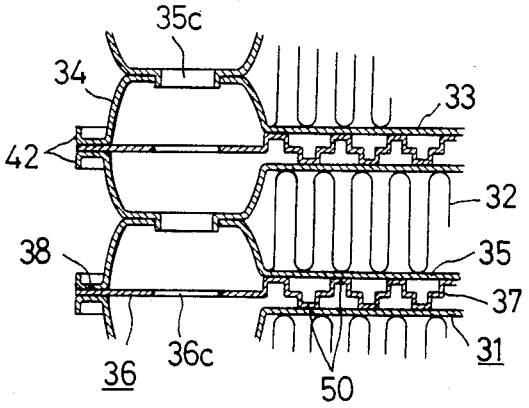
FIG. 5 is a cross-sectional view showing a tank section of the heat exchanger according to the present invention.

The two tray members 35 are soldered to each other in a state shown in FIG. 3, 4 and 5, thereby constituting a unitary body as the planar tubular element 31. In FIG. 1 the reference numeral 45 denotes drains through which the collected dew water is discharged.

The outer fin 32 is made of a corrugated aluminum plate, and has a width equal to that of the tubular element 31. As referred to above the outer fins are fixedly sandwiched between one tubular element 31 and the next, and also jointed to the flat eaves 41. Preferably the corrugated plate is provided with louvers.

In FIG. 2 the reference numeral 46 ad 46′ denote side plates whereby the group of the outer fins 32 is framed. The medium is introduced into the heat exchange through an inlet header 47, and discharged through an outlet header 47′. The inlet header 47 is connected to an inlet pipe 48, and the outlet header 48′ is connected to an outlet pipe 48′

In operation, the medium is introdued into the tubular element of the lowest row through the pipe 48, and flows throughout all the tubular elements, during which heat is exchanged between the medium and the air flowing in the direction (W) through the outer fins 32. The medium is discharged from the outlet header 47′ through the outlet pipe 48′ to a compressor (not shown). In the tubular elements 31 the flow of the medium is blocked by the projections 50 as described above, thereby agitating the medium. This increases the effective area of contact between the molecules of the medium and the projections 50, thereby leading to the efficient transfer of heat. Each tubular element is liable to elongating stresses under which the tanks 34 and the concave bottoms 33 tend to be expanded outward, but the inner plates 36 are effective to protect them against a possible deformation and breakage. In addition, the joint between the tray members 35 is protected against disengagement. Furthermore, because of the plurality of the apertures 36*c* an undesirable stay of the medium is avoided, thereby protecting the tubular elements against a possible breakage. In addition the tubular element 31 is protected by the projections 50 of the inner fins 37 against a possible detrimental compression acting from above or below or both. Thus the heat exchanger withstands a long period of use.

While heat exchange is going on between the air and the medium, water tends to come out of the moisture-contained air. The dew water is forced in the downstream direction along the top surfaces of the tubular elements 31, and finally fall into the troughs 39 as indicated by the arrow (A). The water is discharged out of the heat exchanger through the drains 45.

Another route of water coming from the dew is indicated by the arrow (B) in FIG. 4. This route of water comes partly from the outer fins 32, and partly from the overflown troughs 39. It is obstructed by the edges 36*a* of the inner plates 36 from dropping, and is guided for discharge out of the heat exchanger. In this way the tubular elements are kept free from the dew water, thereby preventing the water droplets from flying about together with the air. This obviates the commonly called "flash troubles" which inflict the people in the car.

Figure 8:
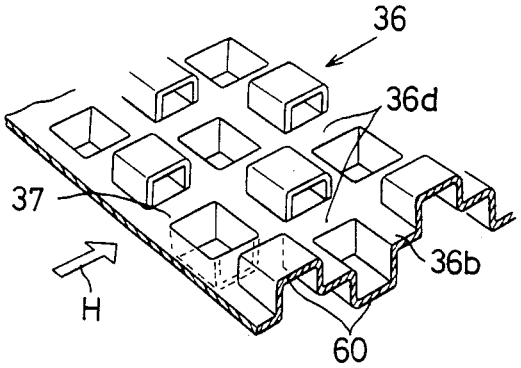
FIG. 8 is a perspective view showing another example of inner fins.

The embodiment shown in FIG. 8 has modified projections 60, which are arranged with flat portions 36*d* being interposed between one projection and the next along the width of the inner plate 36.

Figure 9:
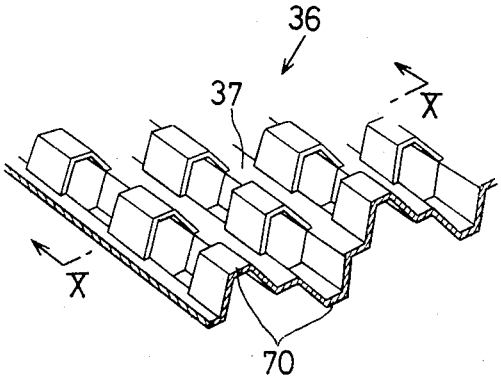
FIG. 9 is a perspective view showing a further example of inner fins.
Figure 10:
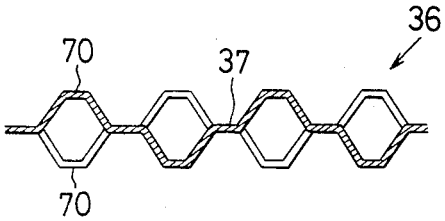
FIG. 10 is a cross-sectional view taken along the X—X in FIG. 9.

The embodiment shown in FIG. 9 and 10 has further modified projections 70, which are semi-hexagonal unlike the above-mentioned rectangular projections 50 and 60.

Figure 11:
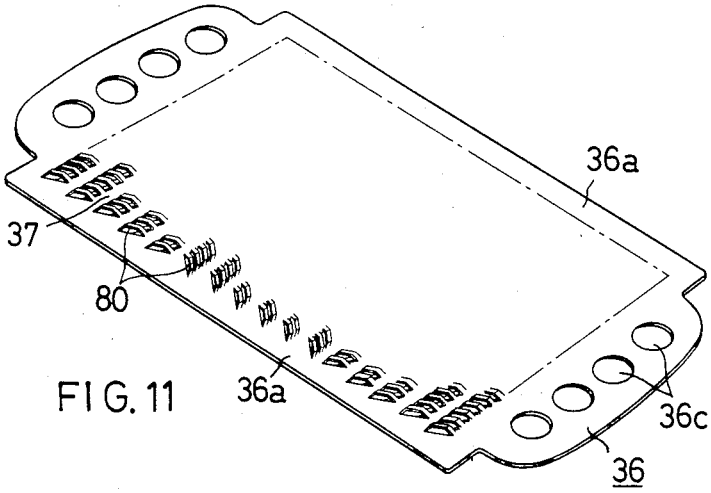
FIG. 11 is a perspective view showing another example of the inner fins.
Figure 12:
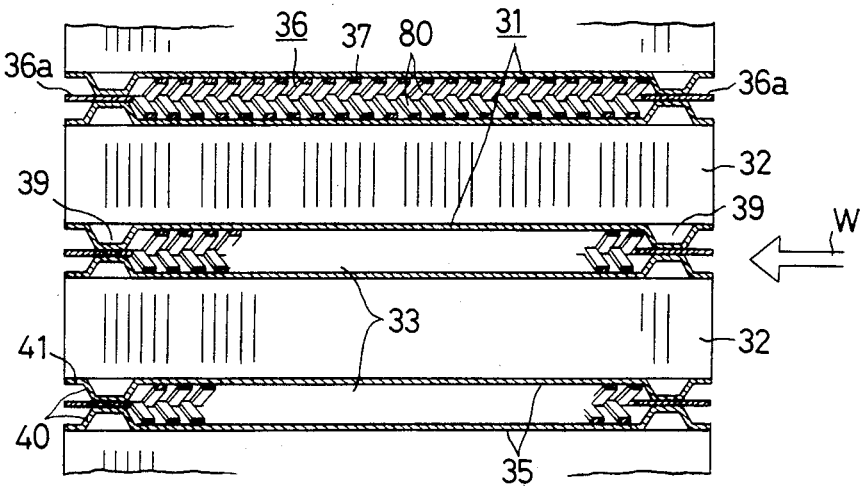
FIG. 12 is a cross-sectional view showing a heat exchanger incorporating the inner fins of FIG. 11.
Figure 13:
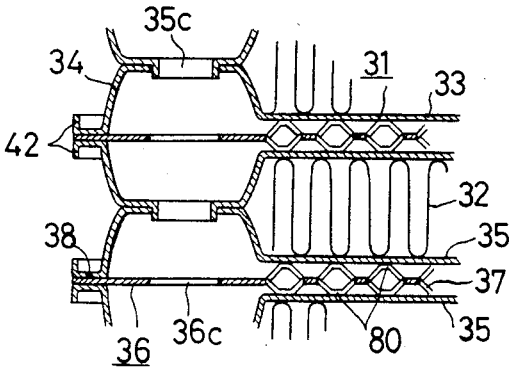
FIG. 13 is a cross-sectional view showing a tank section of the heat exchanger of FIG. 12.
Figure 14:
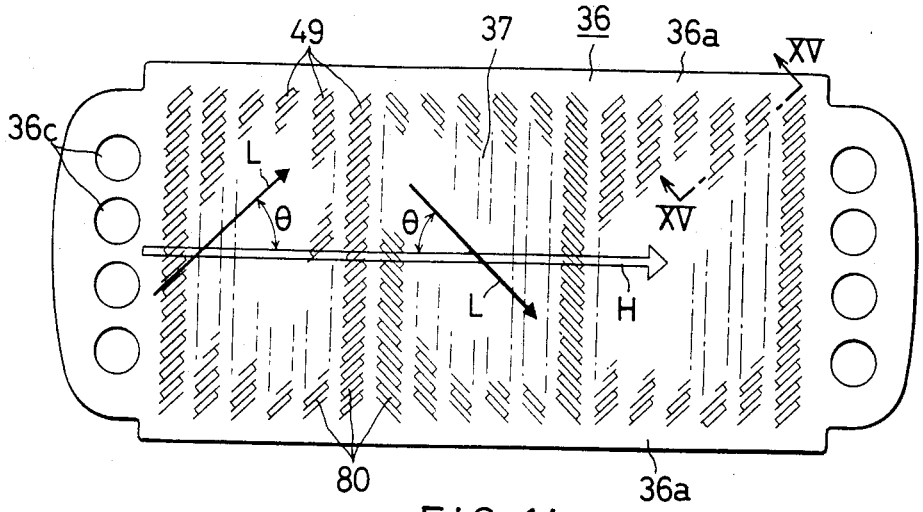
FIG. 14 is a plan view showing the inner plate of FIG. 11.
Figure 15:
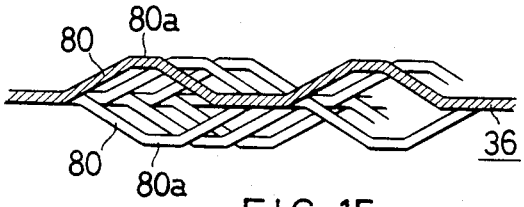
FIG. 15 is a cross-sectional view taken along the line XV—XV in FIG. 14.

FIG. 11 shows a further modification of the projections; each of the modified projections 80 is made up of upward and downward projections. As shown in FIGS. 11, 14 and 15 the inner plate is initially provided with slits each being parallel with the other, and pressed so that the slits are shaped into semihexagonal projections as best shown in FIG. 15. The projections 80 are arranged along the width of the inner plate 36, that is, a direction perpendicular to the flowing direction (H) (FIG. 14) of the medium in such a manner that the upward and downward projections 80 are alternate in a row. In contrast they are arranged in lines in the flowing direction (H) of the medium. Preferably each projection 80 is produced at a given angle $\theta$ to the flowing direction (H) of the medium; in the illustrated embodiment the angle is 45°. In addition each five rows and the next each five rows are different in their directions toward the flowing direction (H) of the medium. These consideration is intended to enable the medium to flow in a zigzag manner. The upward and downward projections have such a height as to keep contact with the tray members 35 jointed to each other.

Figure 16:
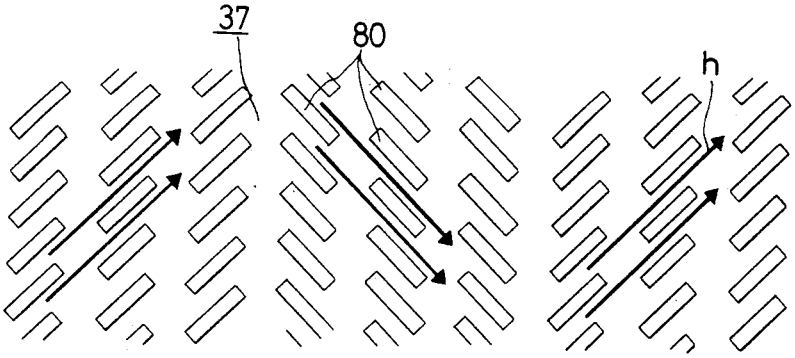
FIG. 16 is a diagrammatic plan view showing the medium flowing through the inner fins of FIG. 14.

Because of the unique shapes and arrangement of the projections 80 the medium is well agitated and flows in zigzag ways as indicated by the arrows (h) in FIG. 16. The collision of the medium with the projections 80 leads to the efficient transfer of heat between the molecules of the medium and the tray members 37.

Figure 17:
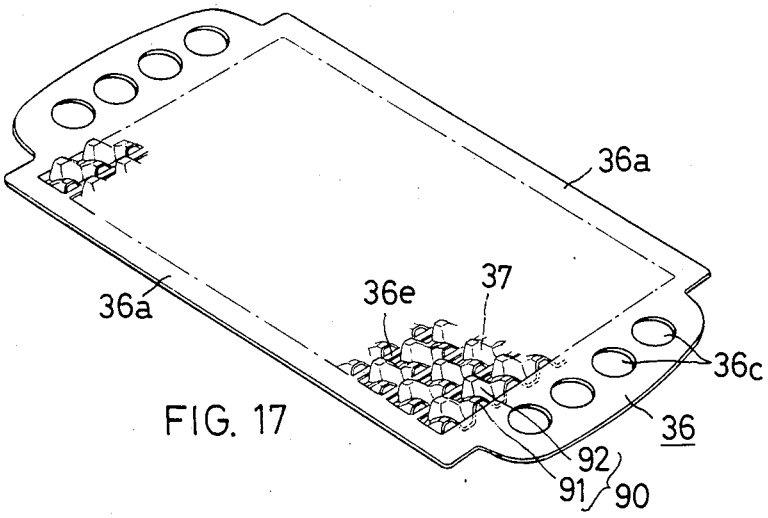
FIG. 17 is a perspective view showing a still further example of the inner fins.
Figure 18:
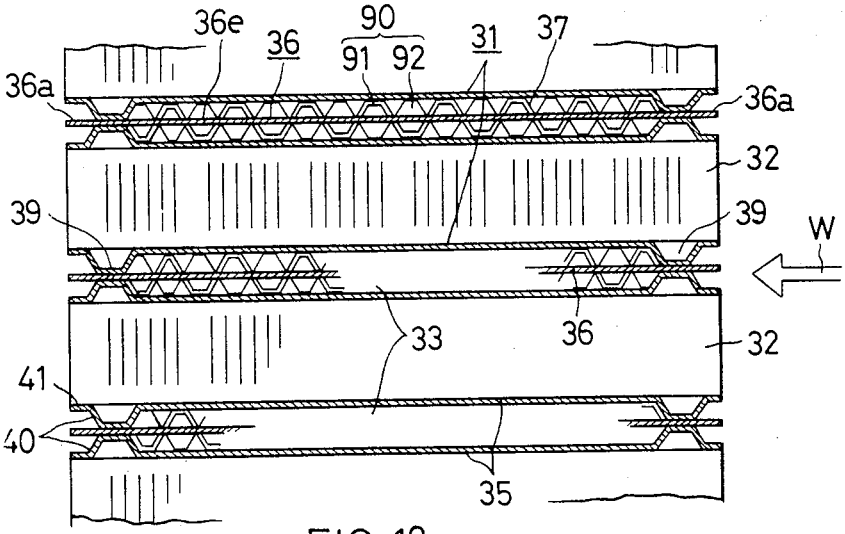
FIG. 18 is a cross-sectional view showing a heat exchanger incorporating the inner fins of FIG. 17.
Figure 19:
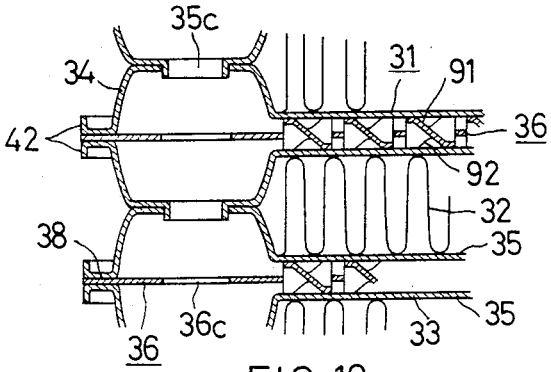
FIG. 19 is a cross-sectional view showing a tank section of the heat exchanger of FIG. 18.

FIG. 17 shows another modified version of the projections; each of this modified projections 90 includes a first guide wall 91 and a second guide wall 92. The first guide wall 91 is to cause the flow of the medium to descend to below the inner plate 36, and the second guide wall 92 is to cause it to ascend to above the inner plate 36. The first guide wall 91 includes a first roof portion 911 having an opening 911*a* upstream of the flow of the medium, and a second roof portion 912 having an opening 912*a* downstream thereof. The first roof portion 911 is upward on the top surface of the inner plate 36, whereas the second roof portion 912 is downward on the undersurface thereof. The second guide wall 92 includes a first roof portion 921 and a second roof portion 922. The first roof portion 921 is downward on the undersurface of the inner plate 36, and has an opening 921*a* upstream of the flow of the medium, and the second roof portion 922 is upward on the top surface of the inner plate 36, and has an opening 922*a* downstream of the flow of the medium. The first and second guide walls 91 and 92 are arranged alternately in a direction perpendicular to the flowing direction (H) (FIG. 20), and arranged in rows along the length of the inner plate 36 with the interposition of flat portions 36*e*. These guide walls 91, 92 are produced by press, wherein the roof portions 911, 912, 921, 922 have a sufficient height to keep contact with the tubular elements 31.

Figure 20:
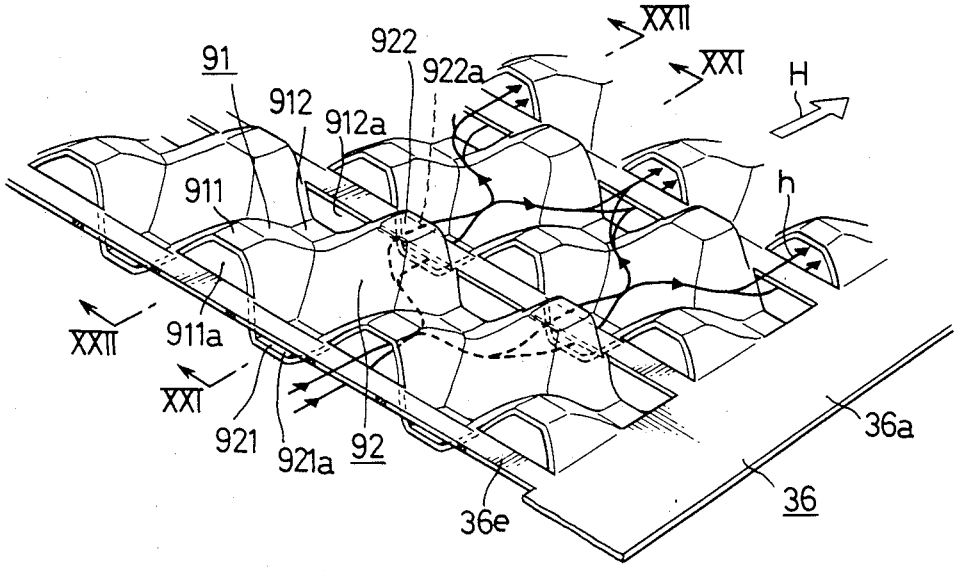
FIG. 20 is a perspective view on an enlarged scale showing the inner fins of FIG. 17.
Figure 21:
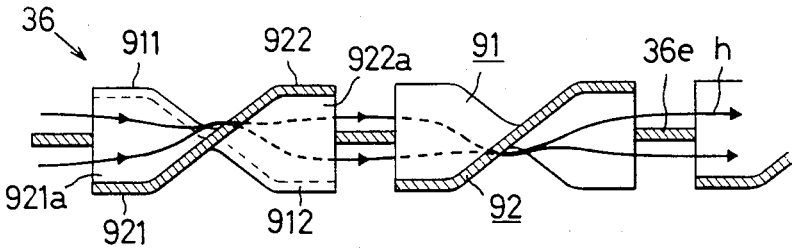
FIG. 21 is a cross-sectional view taken along the XXI—XXI of FIG. 20.
Figure 22:
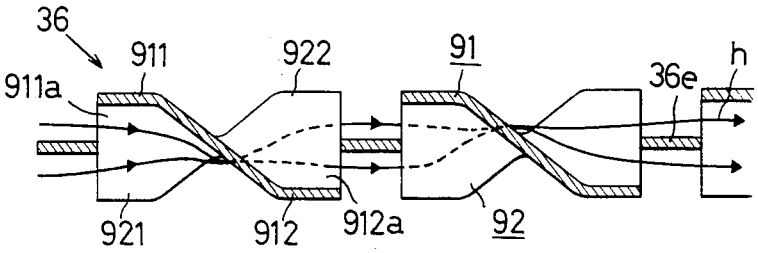
FIG. 22 is a cross-sectional view taken along the XXII—XXII of FIG. 20.
Figure 23:
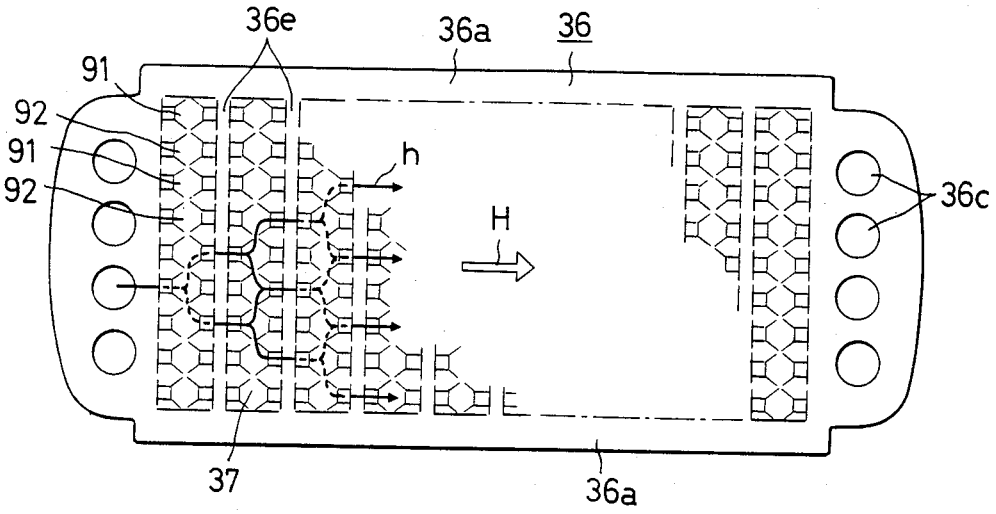
FIG. 23 is a plan view showing the inner plate of FIG. 17.
Figure 24:
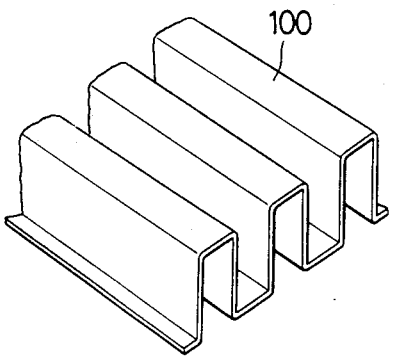
FIG. 24 is a perspective view showing a known inner fin made of a corrugated plate.

In the embodiment illustrated in FIG. 17 the medium flowing above the inner plate is caused to flow into the openings 911*a* and 912*a*, and urged to below the inner plate 36 as indicated by the dotted lines in FIG. 20. Then the medium flow into the openings 921*a* and 922*a;* is urged to above the inner plate 36, and branched into the left- and right-hand directions. In this way it is again urged downward. This rise and fall of the flow of the medium take place around every projection, thereby agitating the medium as indicated by the arrows (h) in FIGS. 20 to 23. As described above the frequent collision of the medium with the projections increases the effective area for heat transfer between the medium and the tubular elements 31.

In the embodiments described above the tubular elements 31 are horizontally stacked but the embodiment is not limited to it; they can be stacked vertically.

What is claimed is:

1. A stack type heat exchanger which comprises:

a plurality of tubular elements including a tank section at least at one end, the tubular elements being adapted to allow a heat exchange medium to pass through;

a plurality of air paths interposed between one tubular element and the next, each of the air paths being provided with a fin member;

wherein each tubular element comprises a pair of metal tray members joined at their peripheries with an inner plate interposed therebetween, said inner plate and said tray members being substantially coextensive;

wherein each inner plate is provided with projections on its top surface and under surface so that the flows of the medium are blocked by the projections so as to enlarge the effective area of contact between the medium and the tubular elements;

said tubular elements and outer fins are alternately stacked horizontally;

each tubular element comprises a trough provided at the air exit side of the periphery thereof;

each said inner plate has edges as opposite sides, the edges extending into spaces defined by the side walls of the trough so as to guide dew water out of the heat exchanger.

2. A stack type heat exchanger defined in claim 1, wherein the projections of the inner plate are arranged in a zigzag manner on the top surface and undersurface.

3. A stack type heat exchanger defined in claim 1, wherein the projections of the inner plate are arranged at a give angle to the flowing direction of the medium.

4. A stack type heat exchanger defined in claim 3, wherein every given number of projections are arranged at different angles to the flowing direction of the medium.

5. A stack type heat exchanger defined in claim 1, wherein each of the projections comprises a first guide wall for guiding one flow of the medium to descend below the inner plate, and a second guide wall for guiding the same flow of the medium to rise above the inner plate, thereby securing the rise and fall of the medium flow through the inner plate.

6. A stack type heat exchanger defined in claim 5, wherein the first guide wall comprises a first roof member on the top surface of the inner plate, the first roof member having an opening upstream of the flow of the medium, and a second roof member provided on the undersurface of the inner plate, the second roof member having an opening downstream of the flow of the medium, and wherein the second guide wall comprises a first roof member on the undersurface of the inner plate, the first roof member having an opening upstream of the flow of the medium, and a second roof member on the top surface of the inner plate, the second roof member having an opening downstream of the flow of the medium.

7. A stack type heat exchanger defined in claim 6, wherein the first guide wall and the second guide wall are arranged alternately along the width of the inner plate, and wherein they are arranged in rows at given intervals along the length thereof.

8. A stack type heat exchanger defined in claim 1, wherein the inner plate comprises medium passageways at opposite ends, the medium passageway comprising a plurality of apertures.

* * * * *